US007353555B2

(12) United States Patent
Lau

(10) Patent No.: US 7,353,555 B2
(45) Date of Patent: Apr. 8, 2008

(54) INFLATABLE MATTRESS ASSEMBLY

(75) Inventor: Vincent W. S. Lau, Sai Kung (HK)

(73) Assignee: Ideal Time Consultants Limited (VG)

( * ) Notice: Subject to any disclaimer, the term of this patent is extended or adjusted under 35 U.S.C. 154(b) by 0 days.

(21) Appl. No.: 11/295,923

(22) Filed: Dec. 7, 2005

(65) Prior Publication Data

US 2007/0124864 A1 Jun. 7, 2007

(51) Int. Cl.
*A47C 27/08* (2006.01)
*A47C 27/10* (2006.01)

(52) U.S. Cl. ..... 5/711; 5/706

(58) Field of Classification Search ..... 5/706, 5/711, 712, 655.3, 710, 713, 644
See application file for complete search history.

(56) References Cited

U.S. PATENT DOCUMENTS

| | | | |
|---|---|---|---|
| 187,397 | A | 2/1877 | MacIntosh et al. |
| 1,371,919 | A | 3/1921 | Mahony |
| 1,625,810 | A | 4/1927 | Krichbaum |
| 1,793,703 | A | 2/1931 | Krichbaum |
| D107,520 | S | 12/1937 | Johnson |
| 2,318,492 | A | 5/1943 | Johnson |
| 2,604,641 | A | 7/1952 | Reed |
| 2,763,013 | A | 9/1956 | Valkenburgh |
| D188,483 | S | 8/1960 | Koenigsberg |
| 3,513,489 | A | 5/1970 | Miller et al. |
| 3,705,429 | A | 12/1972 | Nail |
| 4,056,858 | A | 11/1977 | Weber |
| D253,983 | S | 1/1980 | McRight |
| 4,225,989 | A | 10/1980 | Corbett et al. |
| D263,104 | S | 2/1982 | Stalter, Sr. |
| 4,389,742 | A | 6/1983 | DeWitt |
| 4,405,129 | A | 9/1983 | Stuckey |
| 4,422,194 | A | 12/1983 | Viesturs et al. |
| 4,483,030 | A | 11/1984 | Flick et al. |
| 4,631,767 | A | 12/1986 | Carr et al. |
| 4,745,649 | A | 5/1988 | Wang |
| 4,876,756 | A | 10/1989 | Vaccaro |
| D304,652 | S | 11/1989 | Viesturs |
| D308,403 | S | 6/1990 | LaForce, Jr. |
| D315,188 | S | 3/1991 | Thomas |
| 5,022,109 | A | 6/1991 | Pekar |
| 5,044,030 | A | 9/1991 | Balaton |
| 5,109,560 | A | 5/1992 | Uetake |
| 5,265,293 | A | 11/1993 | Spahn et al. |

(Continued)

FOREIGN PATENT DOCUMENTS

| | | | |
|---|---|---|---|
| DE | 35 35 374 | A1 | 4/1987 |

(Continued)

*Primary Examiner*—Alexander Grosz
(74) *Attorney, Agent, or Firm*—Schweitzer Cornman Gross & Bondell LLP

(57) ABSTRACT

An inflatable mattress assembly having a peripheral frame disposed around an upper periphery of the mattress forming an upper tubular periphery that provides a contiguous support surface. The peripheral frame is secured along two seams so that it is flat, smooth, and immovable. The seam where the peripheral frame is connected to the side layer creates a circumferential, horizontal indentation or groove giving the mattress an appearance that mimics a traditional two-layered pillow-top mattress. The components of the inflatable mattress assembly are in fluid communication with each other.

13 Claims, 4 Drawing Sheets

U.S. PATENT DOCUMENTS

| | | | |
|---|---|---|---|
| 5,287,572 | A | 2/1994 | Strobel |
| D349,145 | S | 7/1994 | Haughey |
| D356,918 | S | 4/1995 | Marshburn |
| D357,156 | S | 4/1995 | Wolfe |
| 5,408,711 | A | 4/1995 | McClelland |
| D365,485 | S | 12/1995 | Rossman |
| 5,493,742 | A | 2/1996 | Klearman |
| 5,561,873 | A | 10/1996 | Weedling |
| 5,598,593 | A | 2/1997 | Wolfe |
| 5,604,945 | A | 2/1997 | Fisher et al. |
| 5,619,764 | A | 4/1997 | Lopau |
| 5,642,544 | A | 7/1997 | Munoz |
| 5,675,855 | A | 10/1997 | Culp |
| 5,711,041 | A | 1/1998 | Chen |
| D391,435 | S | 3/1998 | Song et al. |
| D394,578 | S | 5/1998 | Raburn |
| 5,836,027 | A | 11/1998 | Leventhal et al. |
| D404,955 | S | 2/1999 | Buonocore |
| D405,636 | S | 2/1999 | Stewart |
| D407,785 | S | 4/1999 | Scheurer et al. |
| D407,937 | S | 4/1999 | Klimenko |
| 5,890,245 | A | 4/1999 | Klearman et al. |
| D414,365 | S | 9/1999 | Hsu et al. |
| D414,993 | S | 10/1999 | Bordal et al. |
| 5,960,495 | A | 10/1999 | Hsu et al. |
| D416,426 | S | 11/1999 | Denney et al. |
| 5,987,668 | A | 11/1999 | Ackley |
| 6,015,471 | A | 1/2000 | Rimington et al. |
| 6,016,582 | A | 1/2000 | Larson |
| 6,073,291 | A | 6/2000 | Davis |
| 6,076,214 | A | 6/2000 | Klimenko |
| 6,148,461 | A | 11/2000 | Cook et al. |
| 6,185,770 | B1 | 2/2001 | Wang |
| D455,928 | S | 4/2002 | Fisher et al. |
| D463,703 | S | 10/2002 | Song et al. |
| 6,543,073 | B2 | 4/2003 | Wu |
| 6,568,011 | B2 | 5/2003 | Fisher et al. |
| D490,635 | S | 6/2004 | Boso et al. |
| D509,696 | S | 9/2005 | Torres |
| D509,697 | S | 9/2005 | Torres |
| D509,698 | S | 9/2005 | Torres |
| 2002/0050010 | A1 | 5/2002 | Shimada |
| 2002/0083528 | A1 | 7/2002 | Fisher et al. |

FOREIGN PATENT DOCUMENTS

| | | | |
|---|---|---|---|
| FR | 2 782 254 | A1 | 8/1999 |
| GB | 2 156 209 | A | 10/1985 |

INFLATABLE MATTRESS ASSEMBLY

FIELD OF THE INVENTION

The invention pertains to the field of inflatable mattresses.

BACKGROUND OF THE INVENTION

Inflatable air mattresses are popular because they are portable and have a relatively low cost compared to traditional mattresses. Further, inflatable air mattress designs have been developed to mimic the appearance and comfort provided by traditional two-layered, pillow-top mattresses. However, prior inflatable mattresses were found by many people to be uncomfortable and/or unattractive.

For instance, U.S. Pat. No. 6,076,214 by Klimenko discloses an inflatable mattress having top and bottom layers and having top and bottom peripheral frames wrapped around each layer. The disadvantage with this device is that the top frame is sealed to the bottom frame along a single seam that is substantially interior of the outermost edge of the top frame. While this construction gives the appearance that the upper layer is separate from and lying above the bottom layer it results in unattractive and uncomfortable deformation and creasing of the top frame.

Therefore, it is an object of the invention to provide an attractive and comfortable inflatable mattress that mimics the appearance of a traditional two-layered pillow-top mattress.

It is another object of the present invention to provide an air mattress with a frame extending around the periphery of the mattress top that is secured in a manner so that it is flat, smooth and immovable.

It is another object of the present invention to provide an air mattress with a frame extending around the periphery of the mattress top that is economical to manufacture.

SUMMARY OF THE INVENTION

The foregoing objects are met by the present invention directed to an improved inflatable mattress assembly. The improved inflatable mattress assembly features a main mattress body constructed of top and bottom panels, a peripheral side panel, and a peripheral frame disposed around an upper periphery of the mattress.

The top panel has a plurality of elongated, upwardly extending projections which create a variable-height support surface to provide increased support and comfort. The peripheral frame forms a border for the support surface and may have a vertical height approximately the same as the support projections on the top panel. The top panel forms a portion of the peripheral frame to provide a contiguous support surface. The peripheral frame provides increased comfort to the user by giving extra support and cushioning in an area that frequently gives when the weight of a head is placed thereon. For additional comfort, the top corner areas of the mattress may be seamless.

The peripheral frame is secured along two parallel seams so that it is immovable and not subject to undesirable deformation or creasing. The immovable peripheral frame provides increased comfort as compared to other support structures such as a prior frame fixedly secured along only one seam because the peripheral frame will not crease or undesirably deform when the user places his/her head or other body part thereon. The peripheral frame is in fluid communication with the remainder of the mattress such that the mattress may be inflated from a single inflation valve.

The seam where the peripheral frame is connected to the side layer creates a circumferential, horizontal indentation or groove which gives the mattress an appearance of having a two-layered construction similar to the appearance of a high quality spring mattress that has a pillow-top construction. The groove also gives the mattress an appearance that the two layers are connected to each other.

The inflatable mattress assembly also has support structures inside the main mattress body that are attached to the interior surface of the bottom panel and extend to the interior surface of the top panel. The support structures prevent the top and bottom panels from bowing when inflated and allow the mattress body to form the shape of a traditional mattress.

DESCRIPTION OF THE DRAWINGS

The above and other objects, features and advantages of the present invention will become apparent from the following description of a preferred but, nonetheless, illustrative embodiment of the invention, taken in conjunction with the accompanying drawings, wherein.

DETAILED DESCRIPTION OF THE PREFERRED EMBODIMENTS

Figure 1:
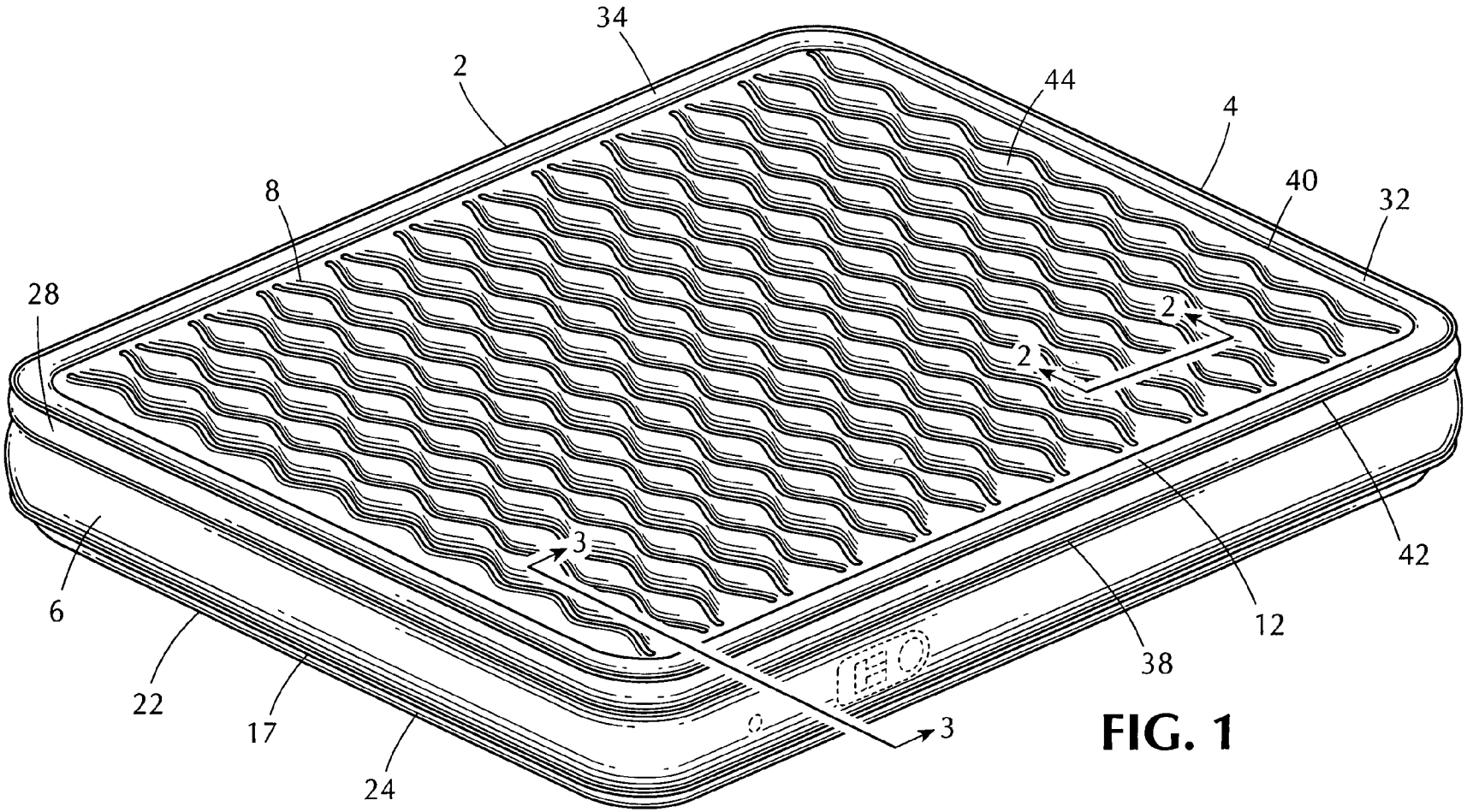
FIG. 1 provides a top perspective view of the improved inflatable mattress assembly.

With particular reference to the drawings, the present invention is directed to an improved inflatable mattress assembly 2. Referring to FIG. 1, the mattress assembly 2 may be in a standard mattress size such as twin, full, queen, and king, or any other suitable size or shape. The inflatable mattress has a top panel 8, bottom panel 22, peripheral side panel 16, and peripheral frame 28 forming a main mattress body 4. The panels and peripheral frame may be composed of rubber, plastic or other materials well known in the art. The panels and peripheral frame 28 may be attached together by heat or by other sealing methods well known in the art.

Figure 2:
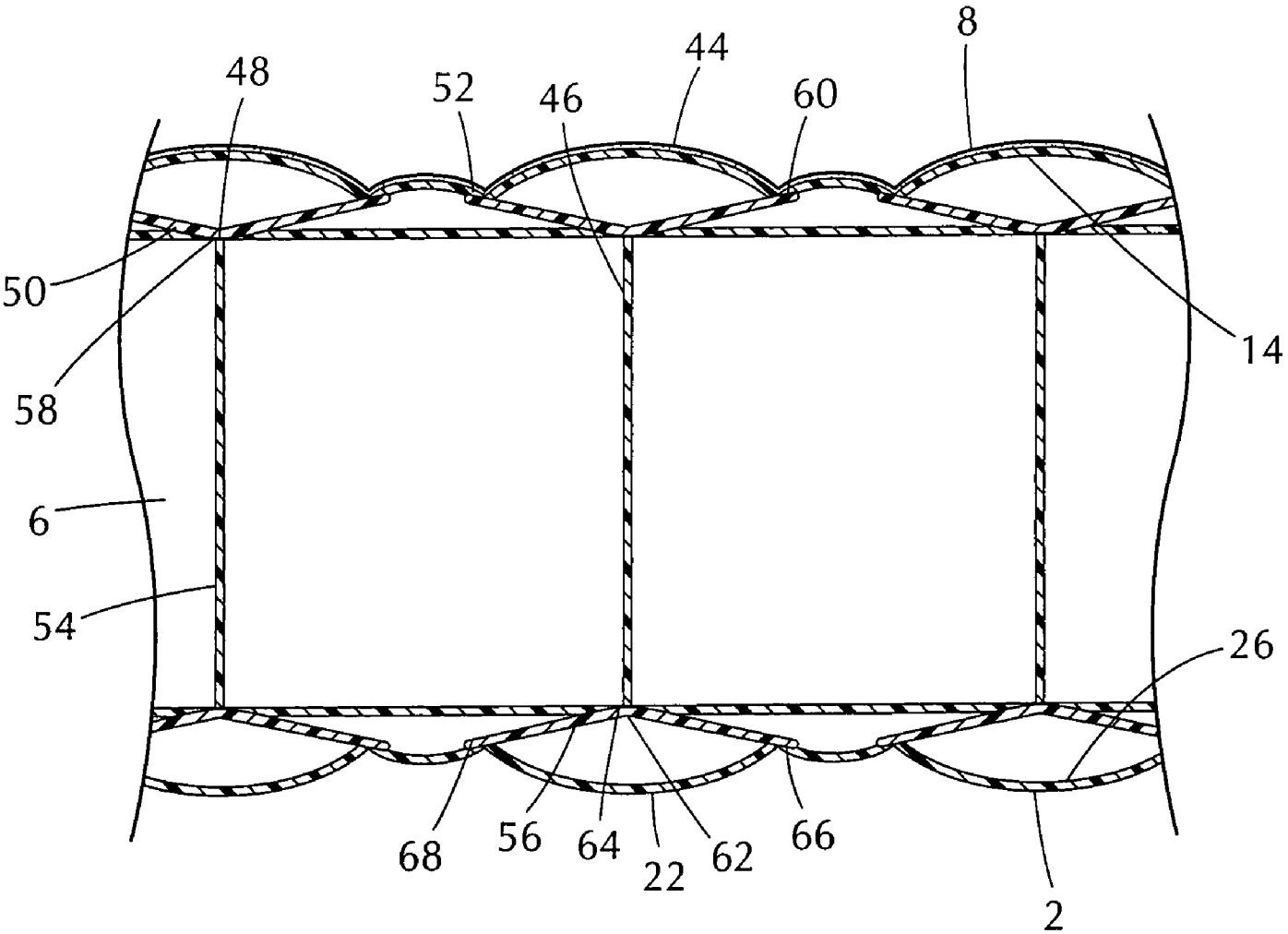
FIG. 2 provides a side elevation sectional view of the inflatable mattress assembly.
Figure 3:
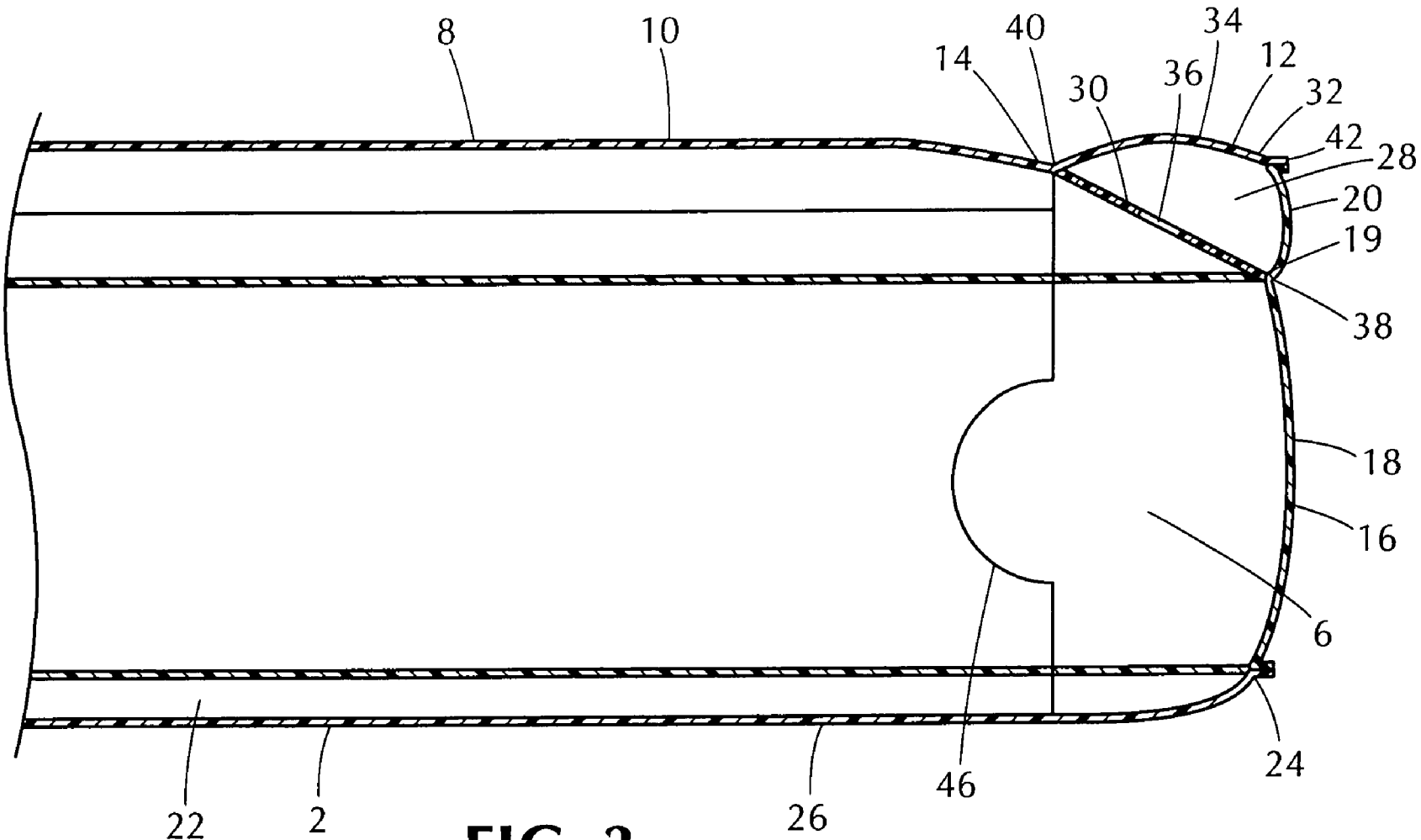
FIG. 3 provides an end elevation sectional view of the inflatable mattress assembly.

Referring to FIGS. 2-3, the peripheral side panel 16 may be an integral piece of material or may consist of several pieces arranged in a contiguous loop. A bottom edge 17 of the side panel 16 is connected to a peripheral edge 24 of the bottom panel 22.

The peripheral frame 28 forms an upper tubular periphery of the inflatable mattress 2. An internal wall 30 of the peripheral frame 28 interconnects the top panel 8 to the side panel 16 and is located within an interior volume 6 of the inflatable mattress 2.

The internal wall 30 is connected to an interior surface 19 of the side panel 16 along a first peripheral seam 38 located substantially below (such as several inches below) a level of the top panel 8. The internal wall 30 is connected to an interior surface 14 of the top panel 8 along a second peripheral seam 40 located substantially inwardly (such as several inches inwardly) from, and aligned substantially parallel to, the first peripheral seam 38. Thus, the internal wall 30 is disposed at a substantially upwardly and inwardly inclined angle.

The peripheral frame 28 also has an external wall 32 interconnecting the first and second seams 38, 40. The external wall 32 forms part of the boundary of the inflatable mattress and has a top portion 34 disposed above a level of the second peripheral seam 40.

The internal wall 30 of the peripheral frame 28 is under tension and preferably includes a fluid passage 36 therethrough such that the internal wall 30 is in substantial pressure equilibrium within the interior volume 6 of the mattress. As such, the internal wall 30 preferably has a substantially linear cross-section between the first and second seams 38, 40.

The peripheral frame 28 is inflated by air pressure within the interior volume 6 of the mattress 2 and the external wall 32 has a substantially curved or arcuate cross-section between the first and second seams 38, 40.

The first seam 38 forms a circumferential indentation or groove in the side panel 16 which provides the appearance that the inflatable mattress 2 has a two-layered, pillow-top construction.

Preferably, the external wall 32 comprises an upper peripheral portion 20 of the side panel 16, which upper portion may be integral with a lower portion 18 of side panel 16. The external wall 32 also preferably comprises an outer peripheral portion 12 of the top panel 8, which outer peripheral portion 12 may be integral with an inner portion 10 of the top panel 8. The upper peripheral portion 20 of the side panel 16 and the outer peripheral portion 12 of the top panel 8 are interconnected along a third peripheral seam 42 located at an extreme periphery of the mattress 2. Thus, the top panel 8 preferably forms the entirety of a support surface of the mattress 2. If desired, the top panel 8 may include a comfortable surface coating such as a felt-like coating, or any other suitable coating, over an entire surface thereof.

A plurality of elongated, lateral support structures 46 interconnect interior surfaces 14, 26 of the top and bottom panels 8, 22 within the interior volume 6 of the mattress 2. Preferably, each support structure 46 is of a double Y-beam construction, having a linear middle portion 54 and a pair of opposed, V-shaped portions 50, 56. An upper V-shaped portion 50 is in an upright orientation and has a base 48 sealed to a top edge 58 of the middle portion 54, and has a pair of spaced-apart, free ends 52, 60 sealed to the interior surface 14 of the top panel 8. A lower V-shaped portion 56 is in an inverted orientation and has a base 62 sealed to a bottom edge 64 of the middle portion and a pair of spaced-apart free ends 66, 68 sealed to the interior surface 26 of the bottom panel.

The V-shaped portions of each support structure 46 form an elongated support projection 44 in the associated top or bottom panel 8, 22 which creates a desirable variable-height support surface. More specifically, the free ends of the V-shaped portions exert a horizontal force on the associated top and bottom panel in a direction towards the base thereof which bows the associated top or bottom panel 8, 22 between the free ends 52, 60 of the V-shaped portions to create a support projection and also flattens the associated top or bottom panel 8, 22 between adjacent V-shaped portions. It can also be appreciated that each double Y-beam also exerts a vertical force on the top and bottom panel towards the middle portion of the Y-beam thereby generally flattening the top and bottom panels to conform to the shape of a traditional mattress. Preferably, the seals between the free ends 52, 60, 66, 68 and the associated top and bottom panels 8, 22 are substantially sinusoidal, which forms major support projections 44 of varying height and width. However, as can be appreciated, such seals may be straight or any other suitable linear or curvilinear configuration.

Figure 4:
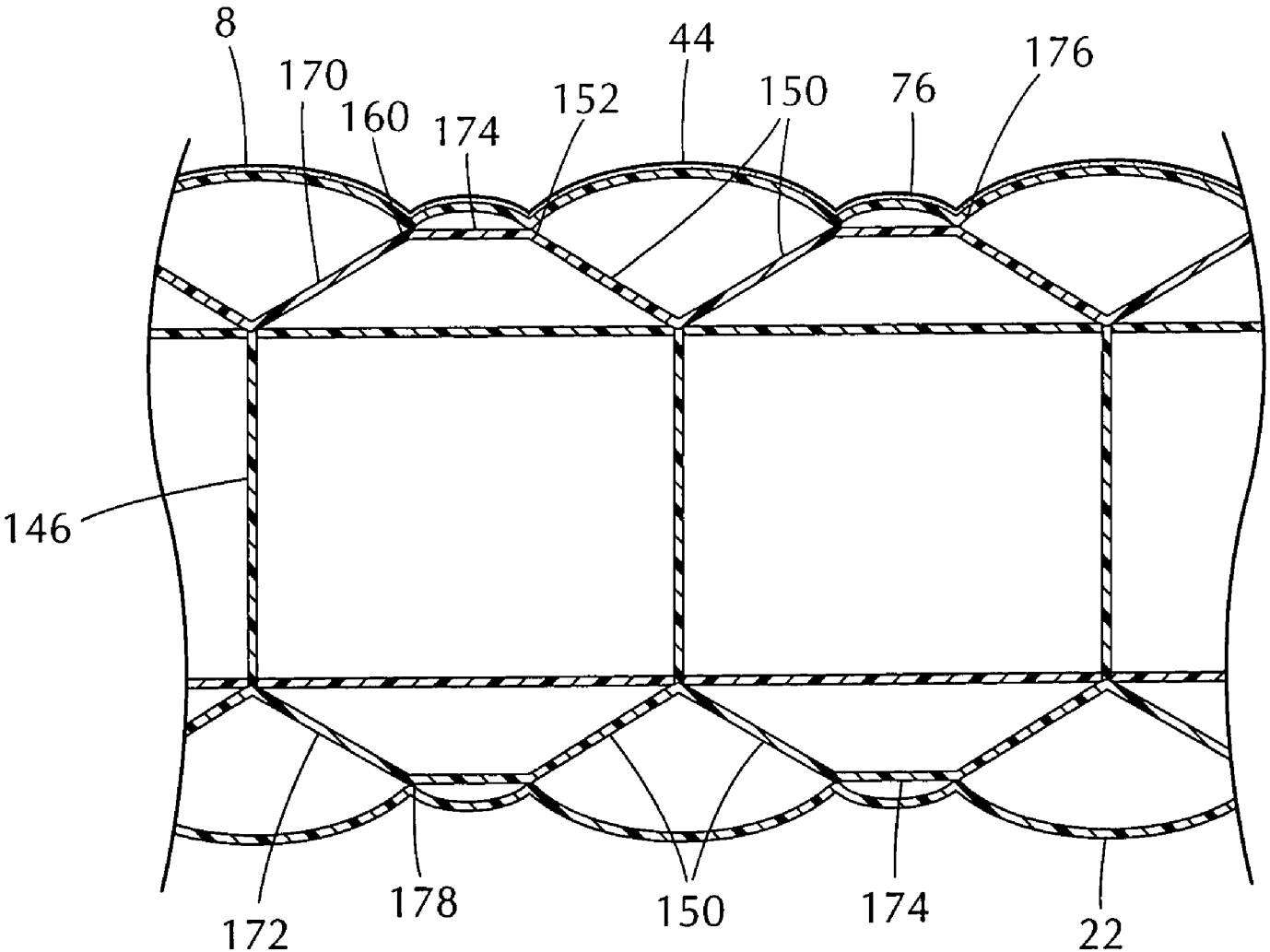
FIG. 4 provides a side elevation sectional view of an embodiment of the inflatable mattress assembly having an upper contiguous interior sheet and a lower contiguous interior sheet.

In the alternative embodiment illustrated in FIG. 4, upper and lower sets of the V-shaped portions 150 of the lateral support structures 146 are formed from upper and lower contiguous interior sheets 170, 172, respectively. The upper contiguous interior sheet 170 underlies and is sealed at certain points 176 to the top panel 8 and the lower contiguous interior sheet 172 lies above and is sealed at certain points 178 to the bottom panel 22. Horizontal support structures 174 of the contiguous sheets 170, 172 span between and interconnect the ends 152, 160 of adjacent V-shaped portions 150, 170 of the upper and lower sets which ends are sealed to the adjacent top or bottom panel 8, 22. The horizontal support structures 174 are in tension and exert a horizontal force on the sealed ends 152, 160, which bows the associated top or bottom panel between the sealed ends, forming a plurality of minor elongated support projections 76 intermediate the major support projections 44. The minor elongated support projections 76 provide increased support and comfort for the user.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

What is claimed is:

1. An inflatable mattress comprising:

top and bottom panels and a peripheral side panel with a bottom edge connected to said bottom panel;

a peripheral frame forming an upper tubular periphery of said inflatable mattress, said peripheral frame having an internal wall interconnecting said top panel to said side panel, said internal wall being within an interior volume of said inflatable mattress;

said internal wall being connected to said side panel along a first peripheral seam located substantially below a level of said top panel and being connected to said top panel along a second peripheral seam located substantially inwardly from said first peripheral seam;

said peripheral frame having an external wall interconnecting said first seam to said second seam, said external wall forming a boundary of said inflatable mattress and having a top portion disposed above a level of said second peripheral seam; and said internal wall of said peripheral frame includes a fluid passage therethrough, said internal wall is in substantial pressure equilibrium within said interior volume, and said internal wall has a substantially linear cross-section between said first and second seams.

2. An inflatable mattress as in claim 1, wherein:

said peripheral frame is inflated by air pressure within said interior volume of said inflatable mattress and said external wall of said peripheral frame has a substantially arcuate cross-section between said first and second seams.

3. An inflatable mattress as in claim 1, wherein:

said first peripheral seam forms an indentation around a circumference of said inflatable mattress thereby providing an appearance of a two-layered, pillow-top mattress.

4. An inflatable mattress as in claim 1, wherein:

said external wall of said peripheral frame comprises an upper peripheral portion of said side panel and an outer peripheral portion of said top panel.

5. An inflatable mattress as in claim 4, wherein said top panel includes a felt-like upper surface over an entire surface thereof.

6. An inflatable mattress comprising:

top and bottom panels and a peripheral side panel with a bottom edge connected to said bottom panel;

a peripheral frame forming an upper tubular periphery of said inflatable mattress, said peripheral frame having an internal wall interconnecting said top panel to said side panel, said internal wall being within an interior volume of said inflatable mattress;

said internal wall being connected to said side panel along a first peripheral seam located substantially below a level of said top panel and being connected to said top panel along a second peripheral seam located substantially inwardly from said first peripheral seam;

said peripheral frame having an external wall interconnecting said first seam to said second seam, said external wall forming a boundary of said inflatable mattress and having a top portion disposed above a level of said second peripheral seam;

said internal wall of said peripheral frame includes a fluid passage therethrough, said internal wall is in substantial pressure equilibrium within said interior volume, and said internal wall has a substantially linear cross-section between said first and second seams; and said peripheral frame is inflated by air pressure within said interior volume of said inflatable mattress and said external wall of said peripheral frame has a substantially arcuate cross-section between said first and second seams.

7. An inflatable mattress as in claim 6, wherein:

said first peripheral seam forms an indentation around a circumference of said inflatable mattress thereby providing an appearance of a two-layered, pillow-top mattress.

8. An inflatable mattress as in claim 6, wherein:

said external wall of said peripheral frame comprises an upper peripheral portion of said side panel and an outer peripheral portion of said top panel.

9. An inflatable mattress as in claim 8, wherein said top panel includes a felt-like upper surface over an entire surface thereof.

10. An inflatable mattress as in claim 8, further comprising:

a plurality of elongated support structures interconnecting said top and bottom panels;

each support structure having a middle member, an upper V-shaped member and a lower V-shaped member;

said upper V-shaped member being in an upright orientation and being attached to a top of said middle member, said upper V-shaped member including a pair of spaced-apart free ends attached to an interior surface of the top of the mattress body; and said lower V-shaped member being in an inverted orientation and being attached to a bottom of said middle member, said lower V-shaped member including a pair of spaced-apart free ends attached to an interior surface of the bottom of the mattress body.

11. An inflatable mattress as in claim 10, wherein said middle member is linear.

12. An inflatable mattress as in claim 10 wherein:

V-shaped members of an upper set thereof are formed from an upper contiguous interior panel and V-shaped members of a lower set thereof are formed from a lower contiguous interior panel;

said upper contiguous interior sheet underlies said top panel and said lower contiguous interior sheet lies above said bottom panel; and said upper and lower contiguous interior sheets form a plurality of horizontal support structures between horizontally-adjacent V-shaped members of said upper and lower sets thereof.

13. An inflatable mattress as in claim 12 wherein said horizontal support structures are in tension.

* * * * *